US006412132B1

(12) United States Patent
Majnaric et al.

(10) Patent No.: US 6,412,132 B1
(45) Date of Patent: Jul. 2, 2002

(54) METHODS FOR CONSTRUCTING A BRIDGE UTILIZING IN-SITU FORMS SUPPORTED BY BEAMS

(76) Inventors: Anton B. Majnaric, 423 S, Medina Line Rd., Copley, OH (US) 44321; John W. Fenton, 2831 Carie Hill Cir., NW., Massillon, OH (US) 44646

( * ) Notice: Subject to any disclaimer, the term of this patent is extended or adjusted under 35 U.S.C. 154(b) by 0 days.

(21) Appl. No.: 09/630,871

(22) Filed: Aug. 2, 2000

(51) Int. Cl.[7] ..... E01D 21/00
(52) U.S. Cl. ..... 14/77.1
(58) Field of Search ..... 14/6, 73, 77.1, 14/77.3; 52/741.1, 742.14, 742.15, 319, 320, 321, 324; 249/207

(56) References Cited

U.S. PATENT DOCUMENTS

| | | | | | |
|---|---|---|---|---|---|
| 1,936,536 | A | | 11/1933 | Bates | |
| 2,114,773 | A | | 4/1938 | Auten et al. | |
| 2,167,413 | A | * | 7/1939 | Bartlett | 249/23 |
| 3,956,864 | A | | 5/1976 | Fung | 52/414 |
| 3,959,940 | A | | 6/1976 | Ramberg | 52/348 |
| 4,227,829 | A | | 10/1980 | Landry, Jr. | 405/20 |
| 4,259,759 | A | * | 4/1981 | Tada | 14/16.1 |
| 4,348,002 | A | * | 9/1982 | Eyden | 249/19 |
| 4,457,035 | A | | 7/1984 | Habegger et al. | 14/18 |
| 4,573,303 | A | * | 3/1986 | Figari | 52/743 |
| 4,604,841 | A | * | 8/1986 | Barnoff et al. | 52/174 |
| 4,865,486 | A | | 9/1989 | Bettigole | 404/75 |
| 5,072,474 | A | * | 12/1991 | Dilger et al. | 14/77.1 |
| 5,092,559 | A | * | 3/1992 | Tjelle | 249/211 |
| 5,104,089 | A | * | 4/1992 | Shook et al. | 249/211 |
| 5,121,518 | A | | 6/1992 | Muller | 14/21 |
| 5,511,268 | A | * | 4/1996 | Albus et al. | 14/77.1 |
| 5,533,221 | A | | 7/1996 | Majnaric et al. | 14/73 |
| 5,549,176 | A | * | 8/1996 | Hawkins | 182/63 |
| 6,273,393 | B1 | * | 8/2001 | McCoy | 249/219.1 |

FOREIGN PATENT DOCUMENTS

| | | | |
|---|---|---|---|
| SU | 1030462 | 7/1983 | 14/18 |
| SU | 1030463 | 10/1983 | 14/18 |

* cited by examiner

*Primary Examiner*—Gary S. Hartmann
(74) *Attorney, Agent, or Firm*—Renner, Kenner, Greive, Bobak, Taylor & Weber

(57) ABSTRACT

A method for constructing a bridge includes the steps of disposing a bridge form and a connected support structure over an area to be spanned by the bridge. Next, concrete is poured into the bridge form. Finally, the support structure is disconnected and removed from the bridge form. The bridge forms are carried or supported by beams positioned over the area to be spanned. The forms may be carried directly by the beams or by support assemblies suspended from the beams may carry the bridge forms. Trolleys may be used to position portions of the forms between or below the beams.

25 Claims, 10 Drawing Sheets

METHODS FOR CONSTRUCTING A BRIDGE UTILIZING IN-SITU FORMS SUPPORTED BY BEAMS

TECHNICAL FIELD

The invention herein resides generally in the art of bridge construction. More particularly, the present invention relates to bridges constructed from forms that are carried by or suspended from temporarily positioned beams.

BACKGROUND ART

There are two commonly-used methods for forming long-span concrete structures such as bridges, parking decks, building floors, structures within stadiums, and the like. These structures may be made by either using pre-cast pieces which are manufactured off-site, and then transported to the construction site and assembled. Alternatively, these structures can be manufactured by building the forms on site, pouring concrete into the forms and then removing the forms.

The pre-cast method utilizes standard or special forms which receive concrete or other structural building-type material. After an appropriate curing time, the form is opened and the piece is removed. Reinforcing members may be included in the form if desired. Utilizing such forms allows the manufacturer to efficiently build a large number of building components to a particular specification depending upon end-use. Although this method is effective, there are high costs involved in shipping and erecting the pre-cast pieces. Additionally, craning the large weight of pre-cast pieces into place adds significant extra cost to high-rise structures.

The other common method for forming long-span concrete structures is where the forms are assembled on site with the desired reinforcing structure. In some instances, significant site preparations are required. Next, the concrete is poured into the form, and after it has set, the forms are removed. This method is also costly inasmuch as the site must be properly prepared to accommodate the form and supporting structure and then the supporting structure must be torn down, cleaned and removed or reinstalled after completion of the concrete pour and setting thereof. Forming the concrete members in place is quite expensive for highly-engineered structures such as bridges, stadiums, and high-rise structures.

One method, which is disclosed in U.S. patent application Ser. No. 09/467,703, filed Dec. 20, 1999, which is incorporated herein by reference, discloses a method for constructing long-span concrete structures utilizing a unique method of pre-stressing the concrete used to form the bridge. This method discloses utilizing beams as supports for forming a beam form upon which a bridge surface is later disposed. Although this method is effective, additional preparation work for preparing the bridge surface is needed. This is especially cumbersome when the span is over water and the support structure must be placed along the length of the beam form.

Therefore, there is still a need to provide a method for in-situ bridge forming which is fast, reliable, and structurally sound.

DISCLOSURE OF INVENTION

In light of the foregoing, it is a first aspect of the present invention to provide a method for constructing a bridge utilizing in-situ forms carried by or suspended from I-beams.

It is thus an aspect of the present invention to provide a method for constructing a bridge in which a bridge form and a connected support structure are disposed over an area to be spanned by the bridge.

It is another aspect of the present invention to provide a method for constructing a bridge, as set forth above, wherein concrete is poured into the bridge forms and after setting, the support structure may be disconnected and removed from the bridge forms.

It is a further aspect of the present invention to provide a method for constructing a bridge, as set forth above, wherein variations of the bridge form and connected support structure are provided. In one variation, at least two beams may be placed in a substantially parallel relationship over the area and decking is placed between the beams to provide a bottom form between the beams. Concrete is then poured into the forms between the beams and after setting, the beams are removed. The formed concrete slabs may then be laterally moved together to complete the bridge structure. In a second variation of the present invention, cribbing may be placed on both sides of the area to be spanned and a cross-beam is set on the cribbing. At least two hanger beams are then placed in a parallel relationship on the cross-beams and over the area. These hanger beams carry support assemblies which carry the bridge forms used to receive the concrete. After the concrete has set, the support structure and hanger beams are removed to provide the desired bridge structure. In a third variation of the present invention, a bottom form may be placed across the abutments prior to placement of the at least two beams which are placed in a substantially parallel relationship over the area. The beams are then secured to the bottom form such that they remain parallel with one another, whereupon end forms may be attached to the bottom form and side forms may be detachably secured to the beams and extend beyond a peripheral edge provided thereby. Concrete is then poured into the formed cavities and, after it has set, the end forms and side forms are removed. Next, the beams are detached from the bottom forms and removed to leave a side cavity which is then filled with concrete to complete the bridge structure.

It is yet another aspect of the present invention to provide a method for constructing a bridge according to the first variation, wherein the parallel beams may be placed upon an abutment which may have notches for receiving the beams.

It is yet another aspect of the present invention to provide a method for constructing a bridge, as set forth above, wherein for the first variation shims are provided to support the beams upon the abutments, and wherein after the concrete has set, the shims are removed so as to transfer weight of the concrete from the beams to the abutments and allow removal of the beams.

It is still another aspect of the present invention to provide a method for constructing a bridge, as set forth above, wherein for the first variation each beam may be provided with a deflection shim along the length of its bottom cross-piece to compensate for the weight of the poured concrete and to facilitate withdrawal of the beams after the poured concrete has set.

It is still a further aspect of the present invention to provide a method for constructing a bridge, as set forth above, wherein for the first variation, the beams may be provided with a plurality of cross-holes that are alignable with the cross-holes of the other beams such that a cross-tie may be inserted therethrough and allow for lateral movement of the slabs after the beams are removed to enhance the structural strength of the completed bridge.

It is an additional aspect of the present invention to provide a method for constructing a bridge, as set forth above, wherein cross-braces may be installed across the beams as part of the support structure to stabilize the beams during pouring of the concrete.

It is still yet another aspect of the present invention to provide a method for constructing a bridge, wherein for the second variation, the hanger beams may be placed in a substantially parallel relationship over the area and may be supported by the cross-beams.

Yet a further aspect of the present invention is to provide a method for constructing a bridge, as set forth above, wherein for the second variation a plurality of support assemblies extend from the hanger beams.

It is another aspect of the present invention for the support assemblies to carry decking and end and side forms that receive the poured concrete. Additionally, the support assemblies include an inverted T-section, wherein one end of a J-hanger is connected to the hanger beam and the other end carries the inverted T-section.

It is still a further aspect of the present invention to allow for length adjustment of the hangers to selectively position the completed deck with respect to the abutments.

It is still yet a further aspect of the present invention to provide a method for constructing a bridge according to the second variation, wherein a trolley may be positionable between adjacent beams for the purpose of carrying decking to a desired position along the length of the beams and wherein use of the trolley may be repeated until the decking extends between the abutments.

It is another aspect of the present invention to provide a method for constructing a bridge according to the second variation, wherein after the decking and forms have been filled with concrete and the concrete has set, the shafts of the hangers are cut to allow removal of the hanger beams.

It is still an additional aspect of the present invention to provide a method for constructing a bridge, as set forth above, wherein the second variation may use a support assembly that includes a member with hangers connected thereto that is positioned substantially parallel with the cross-beams.

It is yet an additional aspect of the present invention to provide a method for constructing a bridge, as set forth above, wherein a trolley assembly may be used to put the members in place and then to use another trolley assembly to place decking and other form materials on the members. As in the other variation, after the concrete has been poured and set, the hanger shafts are cut so as to allow for removal of the hanger beams.

Another aspect of the present invention is to provide a method for constructing a bridge, as set forth above, wherein any of the variations may be pre-assembled near their final location to be spanned and wherein the connected support structure and the pre-assembled bridge structure may be coupled to a moveable counterweight which is then moved to a position over the area.

It is yet another aspect of the present invention to provide a method for constructing a bridge, as set forth above, wherein the movable counterweight is de-coupled from the preassembled bridge structure to allow for pouring of concrete into the forms. The support structure is then disconnected and removed.

It is an additional aspect of the present invention to provide a method for constructing a bridge, as set forth above, wherein the preassembled bridge form and support structure may be formed in half sections in either side of the area to be spanned. Each half section is then connected to a moveable counterweight and then positioned in place and connected to one another.

The foregoing and other aspects of the present invention, which shall become apparent as the detailed description proceeds, are achieved by a method for constructing a bridge, comprising the steps of disposing a bridge form and a connected support structure over an area to be spanned by the bridge, pouring concrete into the bridge form, and disconnecting and removing the support structure from the bridge form.

These and other aspects of the present invention, as well as the advantages thereof over existing prior art forms, which will become apparent from the description to follow, are accomplished by the improvements hereinafter described and claimed.

BRIEF DESCRIPTION OF THE DRAWINGS

For a complete understanding of the objects, techniques and structure of the invention, reference should be made to the following detailed description and accompanying drawings, wherein.

BEST MODE FOR CARRYING OUT THE INVENTION

Figure 1:
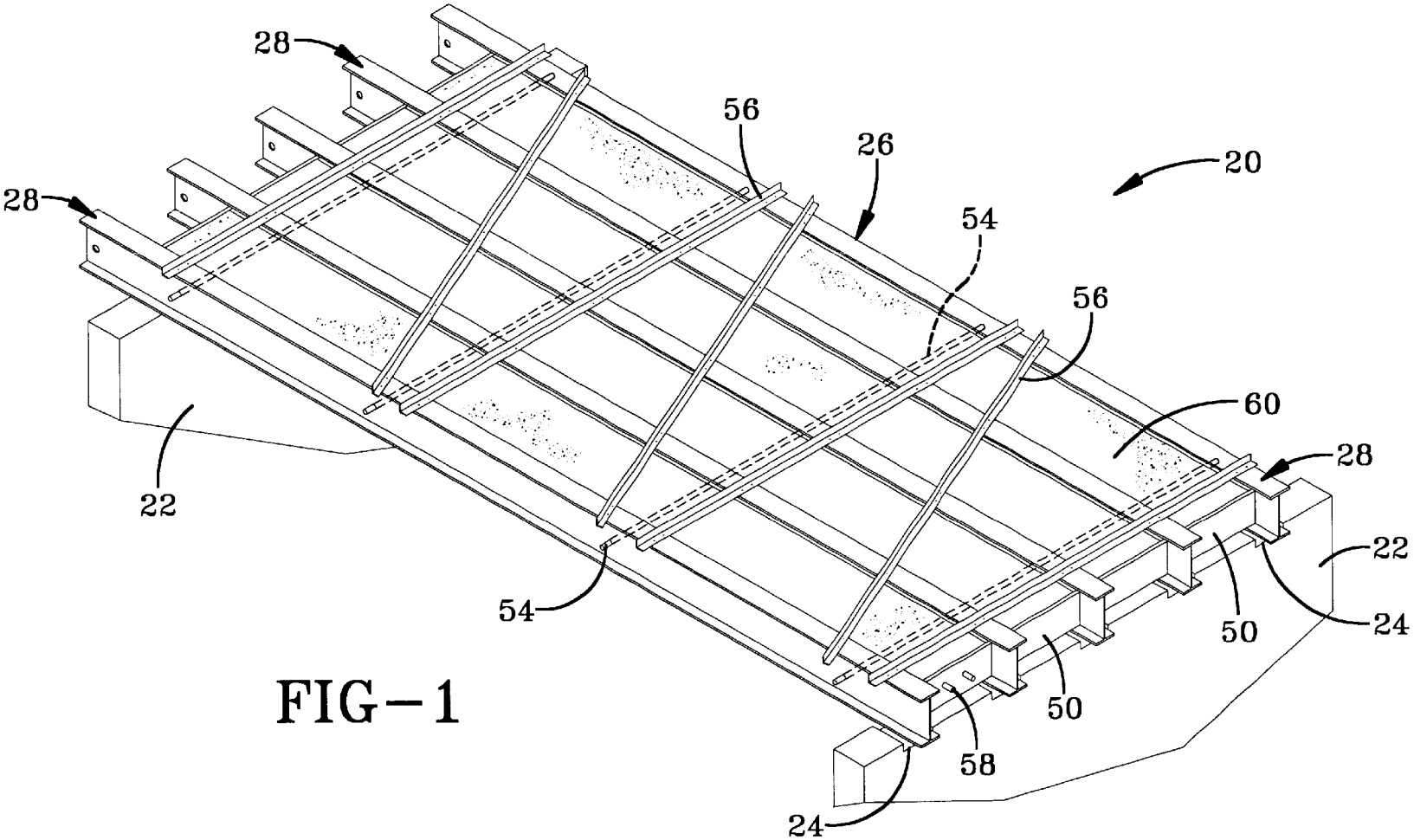
FIG. 1 is a perspective view of a bridge form and supporting structure used according to the methods of the present invention.
Figure 2:
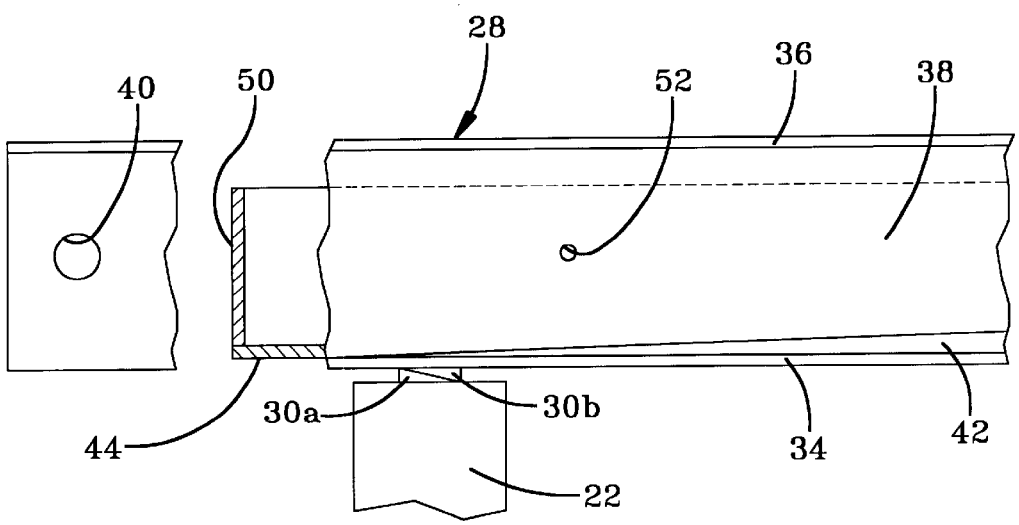
FIG. 2 is a fragmentary elevational view, in partial cross-section, of an abutment supporting a beam used in the bridge form shown in FIG. 1.
Figure 3:
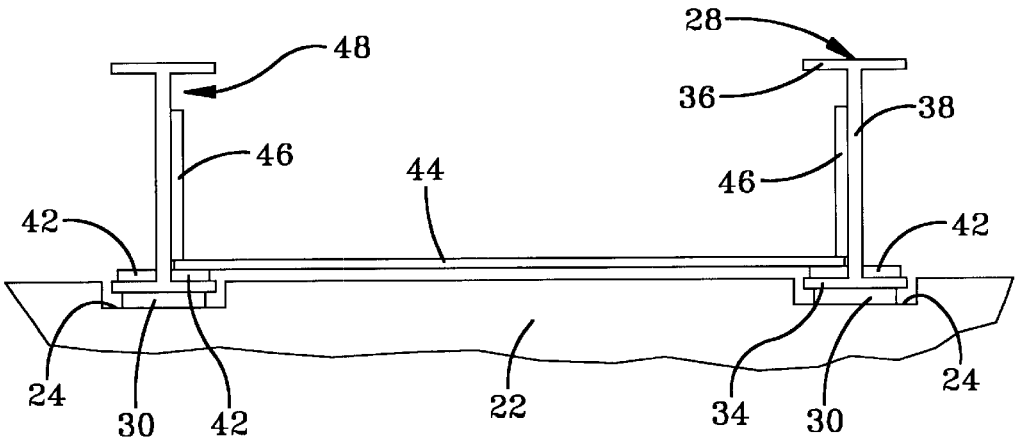
FIG. 3 is a fragmentary end view of two parallel beams supported by the abutment.

Referring now to the drawings and, more particularly, to FIGS. 1–3, it can be seen that a method for constructing abridge utilizing beams for supporting in-situ forms is designated generally by the numeral 20. It is envisioned that bridges made with this construction will be used to cross streams, small valleys, and the like. Generally, the bridge 20 is supported by a pair of opposed abutments 22. The abutments are employed to support the bridge forms, the bridge, and the related supporting structure as needed for the final construction. As shown in the drawings, the abutments 22 are vertically oriented concrete slabs, but those skilled in the art will appreciate that the abutments may be other constructed or natural structures that are strong enough to support the weight of a completed bridge.

The abutments 22 may be provided with a plurality of notches 24 which are uniformly spaced and accommodate portions of a bridge form, generally designated by the numeral 26, as needed to facilitate construction of the bridge.

The bridge form 26 includes at least two uniformly spaced beams 28 which may be placed across the abutments 22 by a crane or set in place by a counterweight device. Although this embodiment shows the beams set in corresponding notches 24, it will be appreciated that use of the notches is not required. A pair of triangularly-shaped shim blocks 30 may be interposed between a bottom surface of the beam and the abutment 22. The shim blocks 30 are employed to support the beams upon the abutment and are later removed to transfer the weight of the completed bridge from the beams to the abutments.

The beams 28 each include a bottom cross-piece 34 which rests upon the abutment 22. The beams also include a top cross-piece 36 that is connected to the bottom cross-piece 34 by a rib 38. The beam may be provided with a hole 40 at either end to allow for grasping of the beam as needed. It will be appreciated that the beam 28 may be an American Standard beam, a beam, a truss, or any structural member that can support or carry a heavy load such as wet concrete.

A deflection shim 42 is disposed on the top surface of the bottom cross-piece 34 on both sides of the rib 38. As best seen in FIG. 2, the deflection shim 42 gradually tapers from a minimum height at an end of the beam 28 to a maximum height somewhere about a mid-portion of the length of the beam 28. From the maximum height, the deflection shim then tapers downwardly to a minimal height at the opposite end of the beam. The taper angle and maximum height of the deflection shim is determined based upon several variables in the bridge construction. Factors in determining the final shape of the deflection shim will become apparent as the description proceeds.

Once all of the beams 28 are placed upon the abutments 22 in a substantially parallel relationship, a plurality of bottom forms 44 are placed upon the deflection shims 42 so as to span the openings between the beams 28. The bottom forms 44 extend between each abutment 22 so as to preclude any openings therebetween. A plurality of side forms 46 may then be placed in an adjacent parallel relationship with the ribs 38. Alternatively, the ribs 38 could be used as the side forms as long as provisions are made so that the concrete to be received in the form does not bond to the ribs 38. This may be done with grease or other appropriate material. It will be appreciated that the side forms 46 are dimensionally sized so as to leave a gap 48 between a bottom surface of the top cross-piece 36 and a top of the side form 46. A plurality of end forms 50 are then extended from the bottom forms 44 and the side forms 46 so as to complete the forming structure between each beam 28. A plurality of cross-holes 52 may be provided in each beam 28. The cross-holes 52 are strategically placed and aligned with the cross-holes 52 of other beams so as to provide a path through the completed bridge construction. A plurality of temporary cross-ties 54 are then threaded through each of the aligned cross-holes 52. A plurality of lateral braces 56 may then be connected to the tops of each beam in a substantially perpendicular or angular configuration. The lateral braces 56 function to maintain the spacing of the beams and ensure that their positioning is essentially perpendicular with that of the abutments 22. Reinforcing steel 58 or the like may then be set within the forms 44, 46, and 50. The steel 58 may be supported by the end forms 50 as shown. All of the forms described in this embodiment may be manufactured from reinforced polymeric material. All forms, in this embodiment and the others to follow, may be made by pultrusion, extrusion, or any process which forms polymeric pieces with the need structural strength characteristics.

Concrete, generally designated by the numeral 60, is then poured into the forms up to the top edge of the side forms 46. As the concrete is poured into these forms, its weight causes the beams to deflect. The amount of deflection is determined by the weight of the particular type of concrete used, the length of the span, the area of the form to be filled, and other related factors. Accordingly, the taper of the deflection shim 42 is calculated to accommodate the weight of the concrete so that the deflection shim is essentially flat or planar from abutment to abutment upon setting of the concrete. Once the concrete has set, the braces 54 are removed and the temporary cross-ties 54 are withdrawn from their respective positions. Once this step is complete, the shims 30, if provided, are removed from their support of the beams 28. The shims 30 may not be required if the depth of the notches 24 allow for the abutments 22 to support the weight of the poured concrete. Accordingly, the weight of the formed slabs 64 is supported by the abutments 22. It will be appreciated that the dimension of the gap 48 is calculated such that the deflection of the beams is compensated for and the beams can be easily withdrawn without interference from the formed slabs. The beams 28 are withdrawn by connecting the appropriate piece of equipment to the holes 40 and pulling the beam outward. Once this step has been completed for all of the beams used in the bridge form 26, a permanent cross-tie may be inserted into each of the aligned cross-holes 52 and the slabs 64 are laterally moved toward one another so as to create a uniform bridge surface. Appropriate filling material may be disposed between the gaps of the slabs and into the cross-holes to preclude entry of moisture between the concrete slabs. Fill material may be placed on either side of the abutment so as to provide the necessary ramping to allow access to the bridge.

Based upon the foregoing, it can be seen that the bridge 20 is easily constructed and significantly reduces the need for unnecessary supporting structure while constructing the bridge. Use of this method reduces construction costs and significantly reduces the amount of time needed to construct the span. Whereas previous methods of construction typically take three to four months, use of the method described above is believed to reduce the construction time to five to six weeks, provided the abutments are in place. This shortened construction time is achieved by eliminating the need for false work and for later removal of the support forms. Moreover, this method reduces any adverse environmental impact, as no support work is required to be placed in the stream or stream bed.

Figure 4:
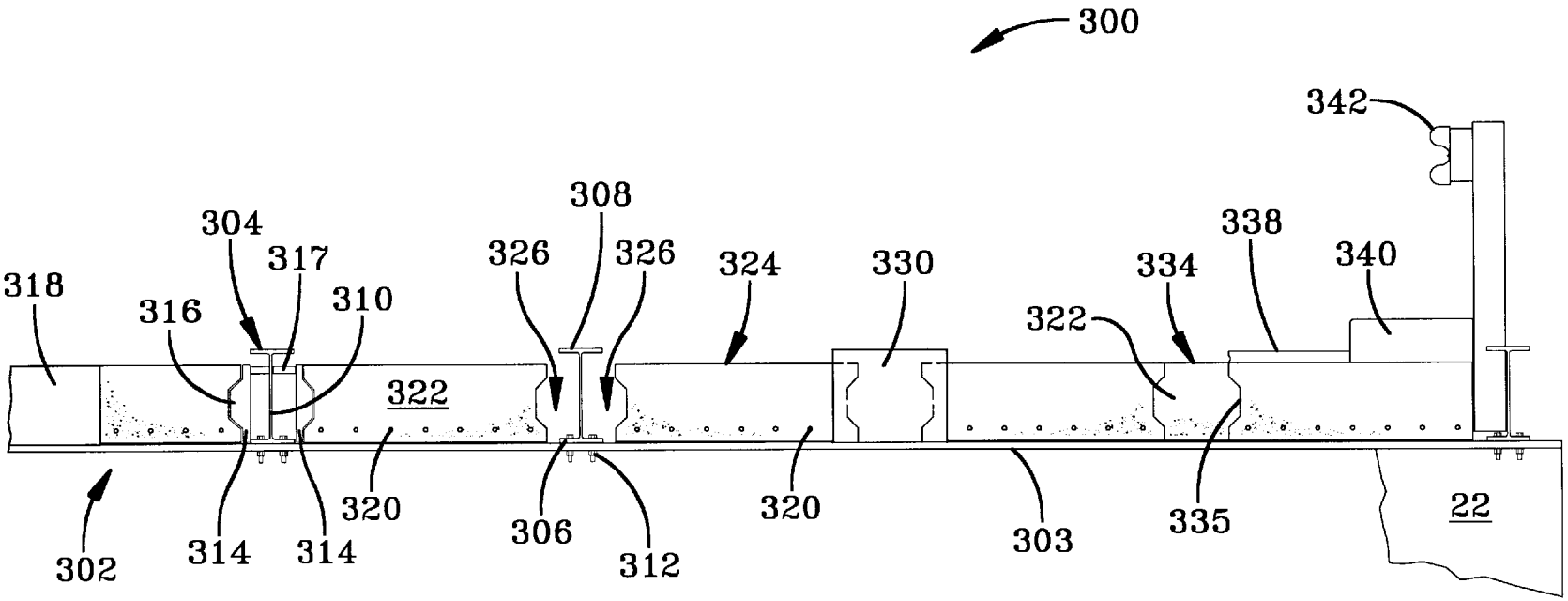
FIG. 4 is an end view, in partial cross-section, of an alternative bridge form and supporting structure used according to the methods of the present invention.

Referring now to FIG. 4, an alternative bridge construction method, designated generally by the numeral 300, is shown. In this embodiment, a bridge form 302 is assembled to facilitate forming the span, then later removed upon completion thereof. This embodiment is constructed by placing a bottom form 303 across the span and attaching it to each abutment 22. At least two beams 304 are placed on top of the bottom form 303 and positioned over the span. The beams 304 are substantially parallel with one another and, depending upon the width of the bridge, additional beams may be placed in a substantially parallel relationship within the outer two beams. Each beam 304 includes a bottom cross-piece 306, a top cross-piece 308, and a rib 310 connecting the cross-pieces to one another. The bottom cross-piece 306 is bolted to the bottom form 303 by bolts 312 or the like on either or both edges of the bottom cross-piece 306.

Side forms 314 are placed between the bottom cross-pieces and top cross-pieces 306, 308 in such a manner that they extend at least beyond the peripheral edge of the cross-pieces. The side forms 314 may be provided with outwardly extending ribs 316. The forms 314 may be laterally supported by horizontal bars 317. The bars 317 may be hinged, or not, to the top edge of the form 314. In either case, the bar 317 is deflectable to allow installation and removal thereof. Once the side forms 314 are installed, end forms 318 are placed at each end of the span to complete the form 302. Reinforcing bars 320 may be placed within the cavity formed by the side forms 314, the end forms 318, and the bottom form 303. Once everything is in position, concrete 322 is poured into the cavities so as to form slabs 324. After the appropriate curing time for the concrete 322, the side forms 314, that bars 317, and the end forms 318 are removed. Removal of the side forms 314 results in the formation of side cavities 326. At this time, the bolts 312 are removed from the beams 304 and the bottom form 303. Preferably, the beams 304 are lifted out by crane, although they could be slid out along the length of the span. Once this is complete, cavity end forms 330 are installed between each formed slab 324 at their respective ends. This encloses the side cavities. Concrete 322 is then poured into these cavities to form a medial slab 334. The medial slabs 334 have outwardly extending ridges 335 as a result of the ribs 316 used in forming the slab 324. After this concrete has set, the end forms 330 are removed. It will be appreciated that the ridges 335 stabilize the entire structure as it spans an area. Upon completion of the medial slabs 334, a wearing surface 338, a curb 340, and a railing 342 may be installed in a manner well known in the art.

It will be appreciated that the embodiment shown in FIG. 4 provides several advantages over the previously discussed embodiments. Primarily, this embodiment does not require the use of shims or other labor-intensive methods for forming the slab. Additionally, the beams 304 may be more easily removed from the formed structure by a lifting crane instead of pulling. Additionally, by not providing the shims along the bottom cross-pieces, a thicker slab may be constructed.

Figure 5:
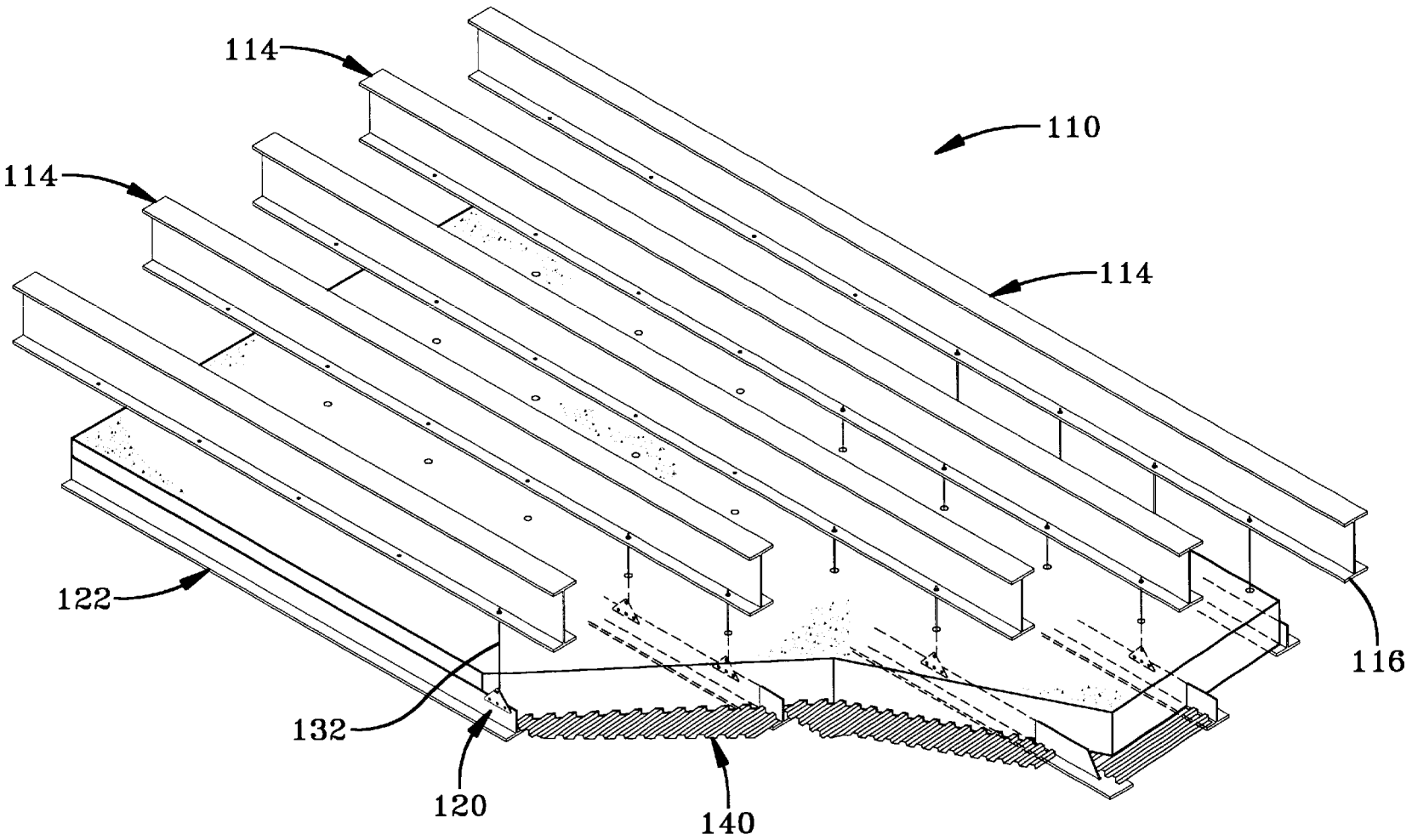
FIG. 5 is a fragmentary perspective view, in partial cross-section, of a plurality of hanger beams and support assemblies used in a variation of the method for constructing a bridge according to the present invention.
Figure 6:
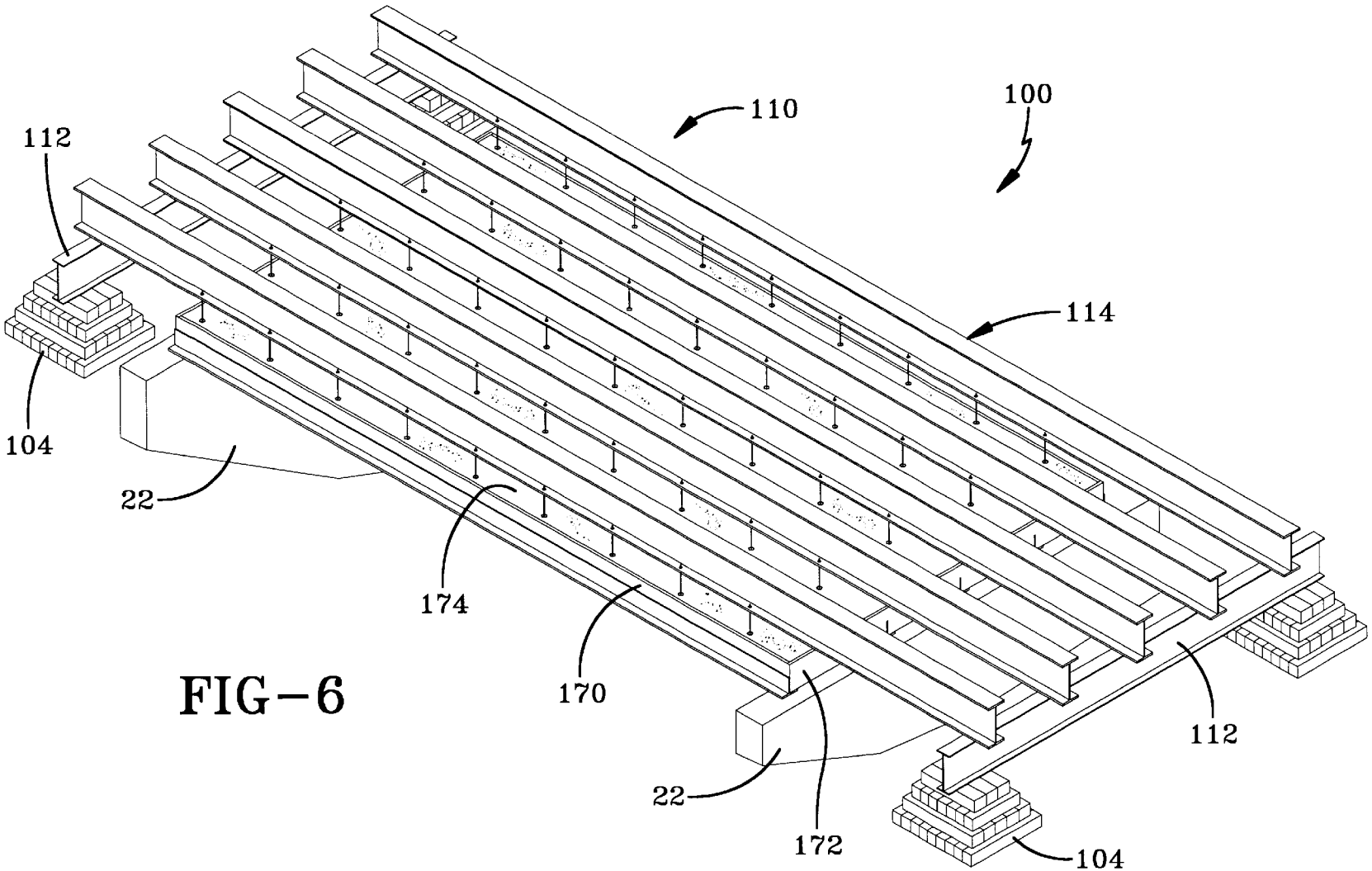
FIG. 6 is a perspective view showing a plurality of cross-beams and hanger beams utilized in constructing a bridge according to the present invention.
Figure 7:
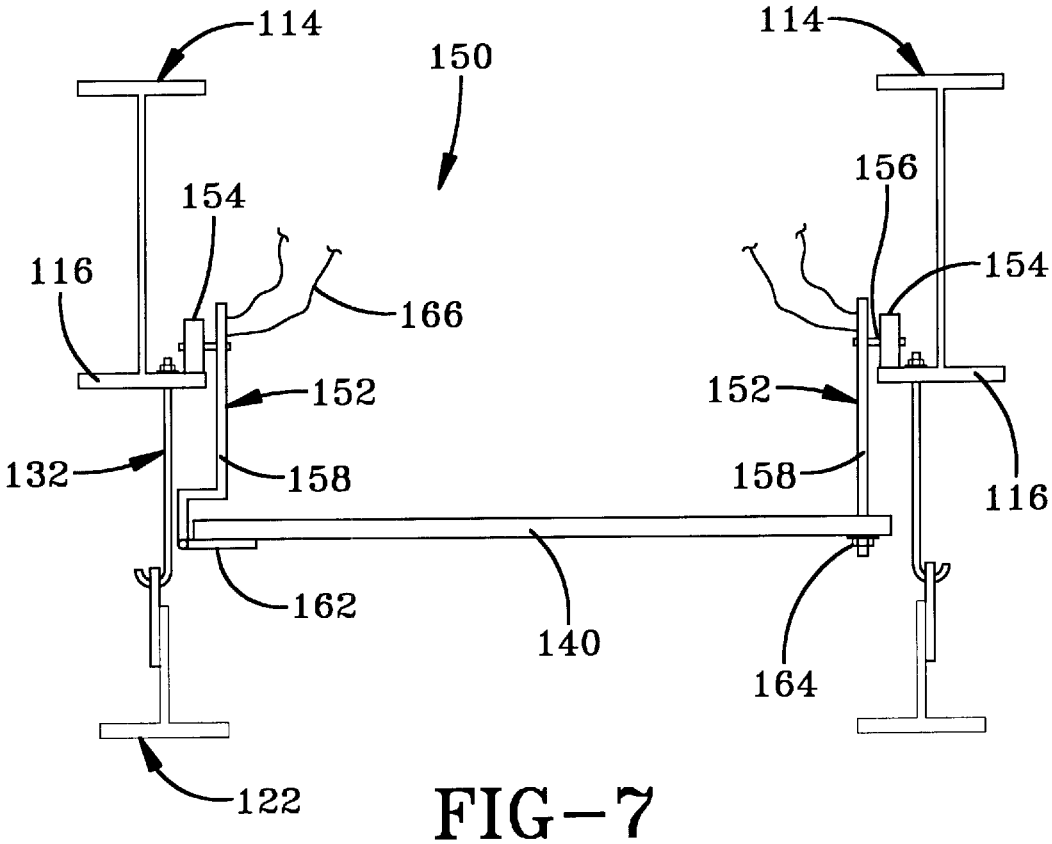
FIG. 7 is an end view of a trolley assembly employed in construction of the bridge shown in FIGS. 5 and 6.

Referring now to FIGS. 5–7, another alternative bridge construction method is shown. As in the previous embodiment, the abutments 22 vertically extend adjacent the area to be spanned. Cribbing, designated generally by the numeral 104, is placed at the outer ends of the abutments, usually higher than the bridge level desired. Cribbing, as understood by those skilled in the art, are timbers or the like used to support other materials.

A bridge form 110 is then constructed over the area to be spanned as follows. First, a cross-beam 112 is set on the cribbing 104 in a substantially parallel relationship with the area to be spanned. A plurality of hanger beams 114 are then disposed in a substantially parallel relationship with one another over the area and are supported by the cross-beams 112. As in the previous embodiment, the hanger beams 114 include a bottom cross-piece 116.

Figure 5A:
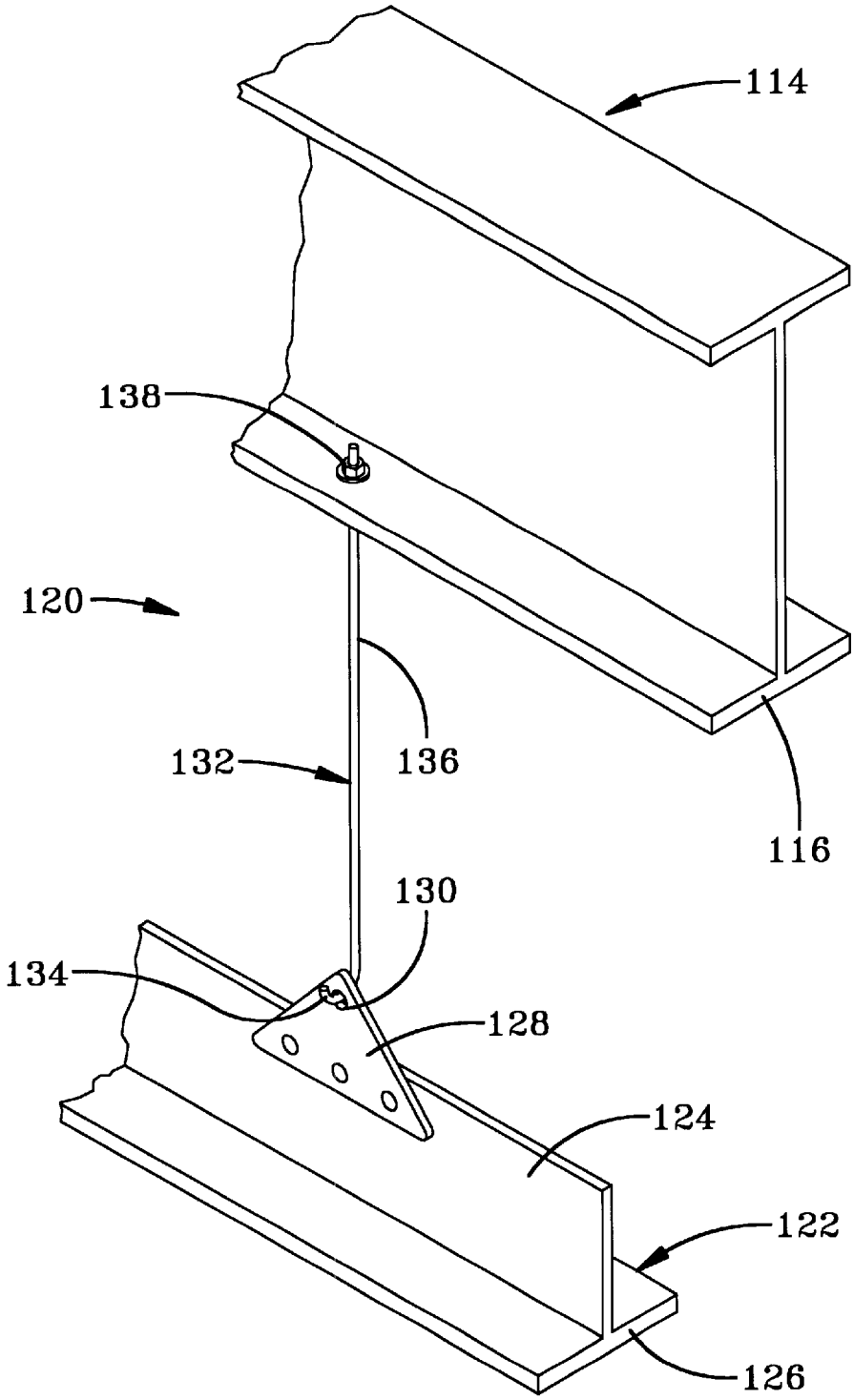
FIG. 5A is a fragmentary perspective view of a support assembly utilized in the bridge construction method of the present invention.

A plurality of support assemblies 120 are then attached to and suspended from the length of each hanger beam 114. As best seen in FIG. 5A, each support assembly 120 includes an inverted T-section 122 that provides a hanger flange 124 which has a substantially perpendicular form flange 126. A bracket 128 is attached or bolted to the hanger flange 124 and is provided in a substantially triangular shape with a portion extending outwardly therefrom. The bracket 128 includes a hole 130 extending through the extending portion.

A J-hanger 132 carries the T-section 122. In particular, the J-hanger 132 includes a hook 124 that extends from a shaft 136 which may be threaded. The hook 134 is received within the hole 130 while the threaded shaft 136 is connected to and/or through the bottom cross-piece 116 by a nut 138. It will be appreciated that the nuts 138 allow for selective positional adjustment of the T-section 122 with respect to the hanger beam 114. Ideally, ends of the form flange 126 are positioned to rest upon the respective abutment 22. As the T-sections span along the length of the hanger beam 114, it will be appreciated that a slight angle may be imparted to the T-section 122 so as to allow for imparting of a camber to the completed bridge construction. In any event, after the support assemblies 120 are connected and placed into their desired position, a plurality of deck pieces 140 are placed upon the form flanges 126. In other words, the decking 140 is placed such that it is carried by the form flanges 26 between the abutments 22.

To install the decking 140, a trolley, such as shown in FIG. 7, may be employed. The trolley, designated generally by the numeral 150, includes a pair of opposed carriers 152. Each carrier 152 includes a roller 154 that is rotatable upon an axle 156. An opposite end of the axle 156 is connected to an arm 158. The roller 154, as shown in FIG. 7, is moveable upon the bottom cross-piece 116. Although not shown, each carrier 152 may employ a second roller that is supported by the bottom cross-piece on the other side of the rib 38. The opposed carrier 152 is placed upon an adjacent beam 114. The arms 158 include a pivot finger 162 or, in the alternative, a nut construction 164 that carries the decking 140. A plurality of pull wires 166 may be connected to the arms 158 to allow for movement of the trolley 150 along the length of the beams 114. The trolley 150 carries the decking 140 to a position along the length of the beams 114. At the appropriate time, the pivot fingers 162 release the decking 140 so that it rests on the form flanges 126 in the desired position. After the decking has been put in place, the pull wires 166 are used to retrieve the trolley to allow for installation of other decking pieces.

Once the decking is installed, a side form 170 and end forms 172 are secured to the decking and the T-sections 122. Once all of the forms are in place, concrete 174 is poured and allowed to set. Once the concrete has set, the shafts 136 are cut flush with the surface of the concrete and the beams 112 and 114 are removed along with the cribbing 104.

This method of bridge construction is advantageous inasmuch as a single slab is formed instead of multiple slabs. Accordingly, the cross-ties are not required in this embodiment. This embodiment provides at least all of the advantages of the previous embodiment. Moreover, the support beams used in this embodiment are easily removed by a crane or a counterweight, without having to slide the beams lengthwise from the formed slabs.

Figure 9:
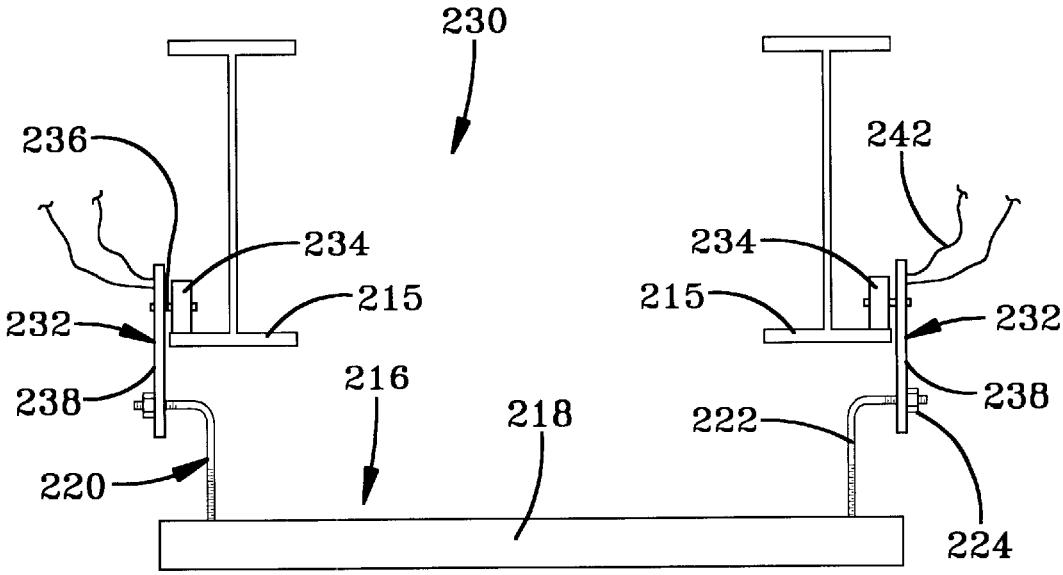
FIG. 9 is an end view of a trolley assembly employed in the construction of the bridge shown in FIG. 8.
Figure 8:
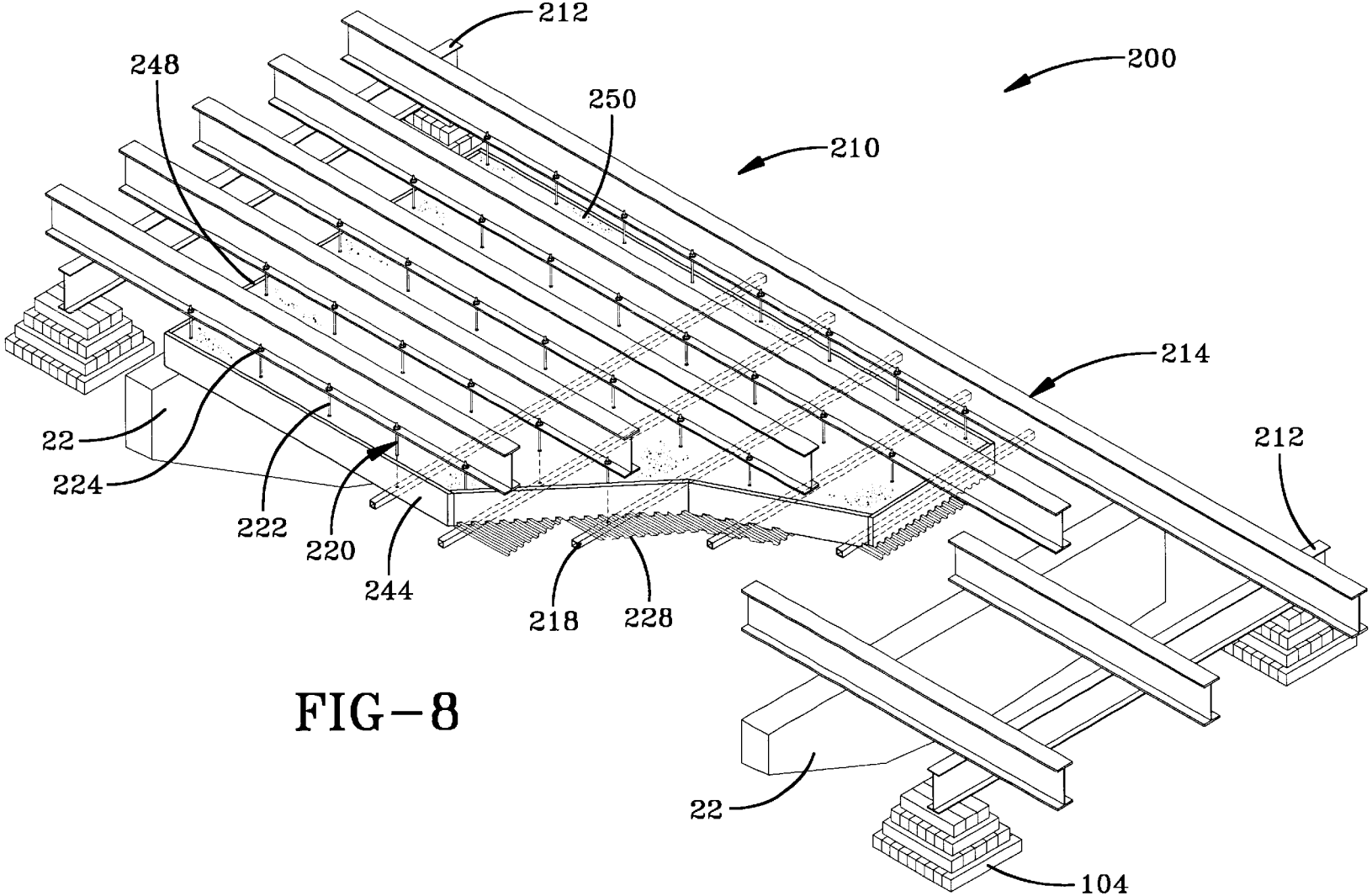
FIG. 8 is a fragmentary perspective view of another method for constructing a bridge according to the present invention.

Referring now to FIGS. 8 and 9, yet another method for constructing a bridge is presented. In this embodiment, a bridge, designated generally by the numeral 200, utilizes the abutments 22 and the cribbing 104 as set forth in the previous embodiment. The bridge 200 includes a bridge form 210 which employs cross-beams 212 supported by the cribbing 104 on each side of the area to be spanned. A plurality of substantially parallel positioned hanger beams 214 are placed upon the cross beams 212.

A support assembly 216 is utilized to carry the concrete forms from the cross beams 212. In particular, the support assemblies 216 are suspended across the hanger beams 214 in a manner similar to that shown in the previous Figs. In particular, the support assembly 216 includes a member 218 which may be a square tube, a rod, or the like. A hanger 220 is connected to at least each end of the member 218 for the purpose of carrying the member. The hanger 220 includes a threaded shaft 222 and the appropriate connection devices 224 such as nuts, hooks, and the like. Along with the required hangers 220 at each end of the member 218, the member 218 may include additional hangers along its length so as to connect with hanger beams 214 disposed in between the outermost hanger beams 214.

A plurality of decking forms 228 are then disposed on and supported by the members 218. The decking 228 may be one continuous sheet of material or may be a plurality of sheets positioned to rest upon the members 218.

A trolley, as best seen in FIG. 9, is designated generally by the numeral 230, may be employed to carry the members 218 to the appropriate position along the length of the bridge form 210. The trolley 230 includes a pair of carriers 232, each having a roller 234 connected to an axle 236. Although not shown, each carrier 232 may have a second roller that is supported by the bottom cross-piece on the other side of the rib 38. An arm 238 extends from the axle 236 and carries the hanger 220 for carrying the member 218. The hanger 220 is connected at one end of the tube or member 218 and the threaded shaft 222 is then later connected to the bottom cross-piece 215 when in the desired position. Any means known in the art may be employed to connect the shaft 222 to the beams 212. A pull wire 242 may be employed to move the trolley 230 from one end of the bridge form 210 to the other. It will be appreciated that the underside of the decking is supported by at least the top surface of the abutments 22. Once all of the decking is in place, side forms 244 and end forms 248 are employed to complete formation of the bridge form 210. Concrete 250 is then poured into the form and allowed to set. Once the concrete is set, the shafts 222 are cut flush with the top surface of the concrete. Next, the cross-beams 212, hanger beams 214, and any extraneous-forming material that is not retained by the formed concrete piece, is removed. Those skilled in the art will appreciate that this embodiment has the advantage of utilizing much simpler pieces to create the concrete form. Moreover, this embodiment provides the advantages of the previously discussed embodiment.

As an alternative to forming the bridge forms over the span, with their attendant difficulties in aligning the forms, the members, and related materials, it will be appreciated that the forms may be assembled at a location somewhat removed from the area to be spanned.

Figure 10A:
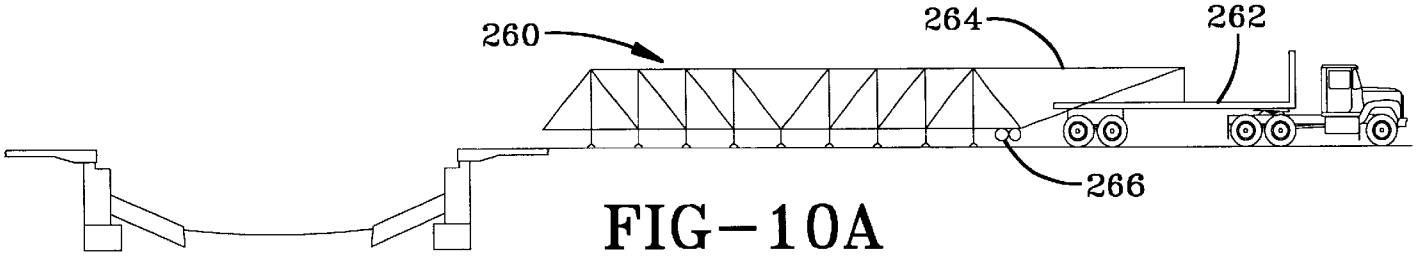
FIGS. 10A–C show a method for constructing a bridge form and connecting structure off-site and employing a moveable counterweight to place the bridge over an area to be spanned.
Figure 10B:
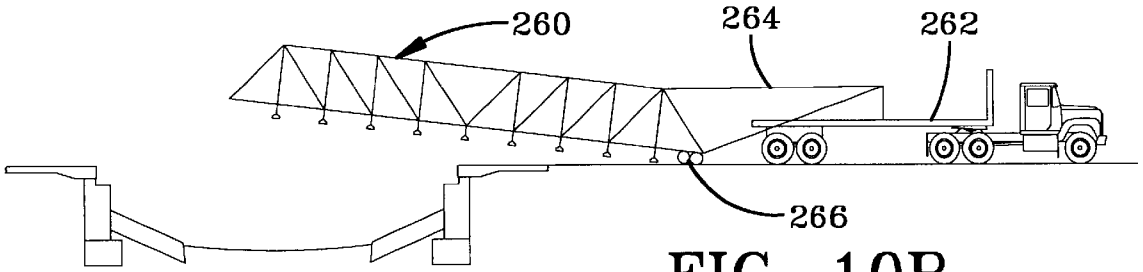
Figure 10C:
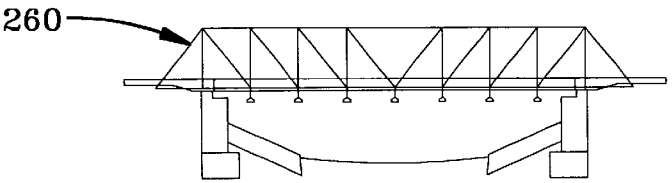

Referring now to FIGS. 10A–C, it can be seen that a bridge form with truss supports, designated generally by the numeral 260, may be constructed at one side of the area to be spanned. A truck 262 with an attached harness 264 is then connected to the truss 260. The connection between the truss support 260 and the truck 262 includes a plurality of wheels 266 so as to allow slight pivoting of the truss support 260. Those skilled in the art will appreciate that the truck 262 is a counterweight to the truss support 260 so as to allow for movement of the truss support 260. The truss support 260 is then positioned over the span and connections are made to the adjoining abutments. Once the truss support is put in place with the appropriate forms, concrete is poured and the bridge construction is completed upon setting of the concrete.

Figure 11A:
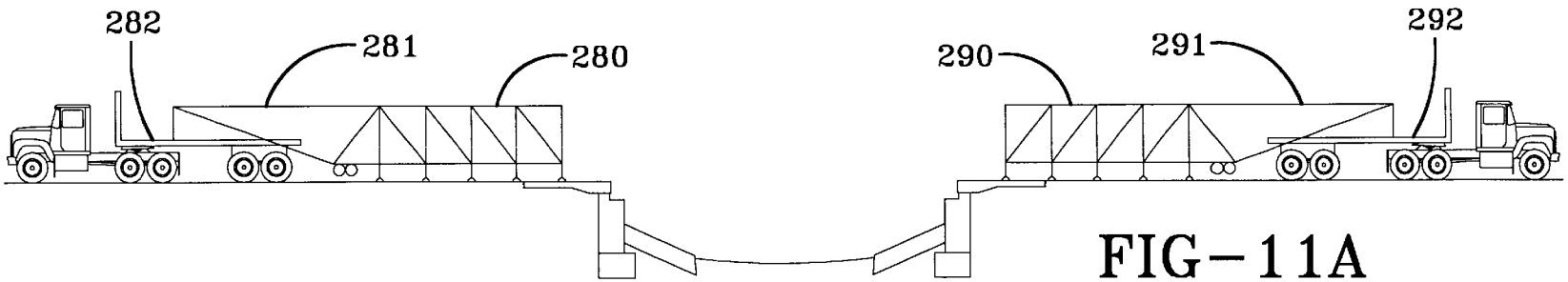
FIGS. 11A–C show a similar methodology for constructing a bridge form and connecting structure off-site and moving it over into the area to be spanned, wherein the bridge form and connecting structure is divided in half and moved over the span from either side thereof.
Figure 11B:
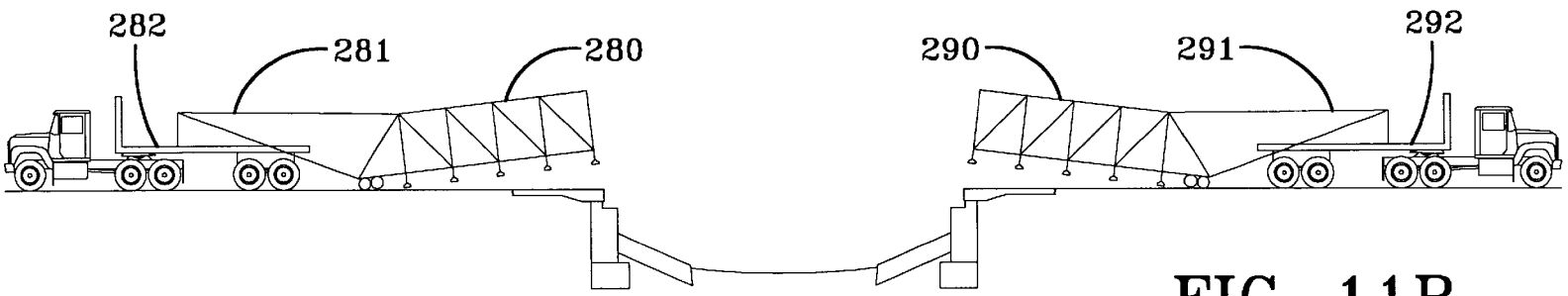
Figure 11C:
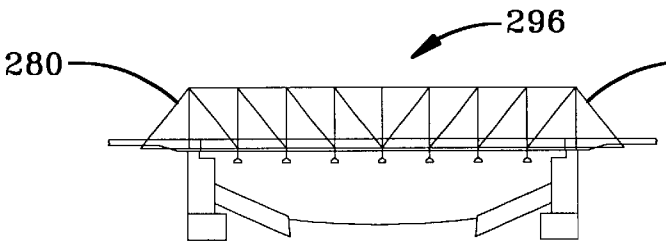

A similar construction or methodology of constructing a bridge is shown in FIGS. 11A–C, wherein a first truss 280 is connected to a first truck 282 with a harness assembly 281. Likewise, on the other side of the area to be spanned, a second truss assembly 290 is connected by harness 291 to a second truck 292. These trusses are then placed over the span and connected to one another at their ends. The harnesses are then disconnected from their respective trusses. Concrete is poured into the appropriate forms and allowed to set. The harnesses and trucks are removed from the trusses and upon the concrete setting, the bridge is ready for use.

The embodiments shown in FIGS. 10 and 11 allow for off-site construction of the bridge truss and forms which is much easier and more cost effective than constructing the bridge and forms over the area to be spanned. In addition to the benefits of the other embodiments, these constructions are inherently safer to build as they are formed in a safe area as opposed to being formed over the span.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of true scope and breadth of the invention, reference should be made to the following claims.

What is claimed is:

1. A method for constructing a bridge, comprising the steps of:

disposing at least one bridge form and a connected support structure, over an area to be spanned by the bridge by placing at least two supported beams in a substantially parallel relationship over the area, each of the beams having at least a bottom cross-piece and a rib extending substantially perpendicularly from said bottom cross-piece and placing a bottom form between adjacent beams so that said bottom form is carried by said corresponding bottom cross-pieces;

pouring concrete into said at least one bridge form; and disconnecting and removing support structure from said at least one bridge form.

2. The method according to claim 1, wherein said disposing step further comprises the step of preparing an abutment at both sides of the area to be spanned.

3. The method according to claim 2, wherein said disposing step further comprises the steps of:

supporting said two beams with said abutments; and assembling end forms at each end of said bottom from prior to said pouring step, said at least two beams forming said support structure.

4. The method according to claim 3, wherein said disposing step further comprises the steps of:

placing at least a third beam in a substantially parallel relationship with said other beams over the area;

installing side forms on said beams, wherein said side forms extend further than said bottom cross-pieces; and removing said side forms and said beams after said concrete has set to form slabs with side cavities therebetween.

5. The method according to claim 4, further comprising the steps of:

installing cavity end forms at the end of each said slab to partially enclose said side cavities; and pouring concrete into said side cavities to form median slabs between said slabs.

6. The method according to claim 5, further comprising the steps of:

providing said side forms with outwardly extending indentations at said installing side forms step; and removing said cavity end forms.

7. The method according to claim 3 further comprising the steps of:

installing a deflection shim along the length of said bottom cross-pieces to compensate for the weight of said poured concrete;

transferring the weight of said poured concrete from said beams to said abutments; and withdrawing said at least two beams, such that said concrete slabs span said abutments.

8. The method according to claim 7, wherein said disposing step further comprises the steps of:

providing each said beam with a plurality of cross-holes that are alignable with said plurality of cross-holes of adjacent beams;

inserting temporary cross-tie forms through said plurality of aligned cross-holes prior to said pouring step; and pulling said concrete slabs together after withdrawal of said beams.

9. The method according to claim 8, further comprising the steps of:

removing said temporary cross-tie forms prior to withdrawal of said beams; and installing permanent cross-ties through said plurality of aligned cross-holes after withdrawal of said beams.

10. The method according to claim 7, wherein said disposing step further comprises the step of installing cross-braces across said beams as a part of said support structure.

11. A The method according to claim 7, wherein said disposing step further comprises the steps of:

disposing a shim between said abutment and said beams at each end prior to said pouring step; and removing said shims after said concrete has set to transfer weight from said beams to said abutments.

12. The method according to claim 7, wherein said disposing step further comprises the steps of:

notching said abutments to a depth sufficient to receive said bottom cross-piece;

disposing a shim between said abutment and said beams at each end prior to said pouring step; and removing said shims after said concrete has set to transfer weight of the concrete from said beams to said abutments.

13. The method according to claim 7, further comprising the step of notching said abutments to a depth sufficient to receive said bottom cross-piece such that said bottom cross-piece is at least flush with said abutment, wherein said bottom form and the weight of said concrete are supported by a top surface of said abutment.

14. A method for constructing a bridge, comprising the steps of:

disposing at least one bridge form and a connected support structure, over an area to be spanned by the bridge, wherein said disposing step further comprises the steps of:

preparing an abutment at both sides of the area to be spanned;

placing cribbing on the sides of said abutments away from the area:

setting cross-beams on said cribbing substantially parallel with the area;

placing at least two hanger beams in a substantially parallel relationship over the area, each of said hanger beams having at least a bottom cross-piece supported by said cross-beams and a rib extending substantially perpendicularly from said bottom cross-piece, said cross-beams and said hanger beam forming said support structure;

pouring concrete into said at least one bridge form; and disconnecting and removing support structure from said at least one bridge form.

15. The method according to claim 14, wherein said disposing step further comprises the steps of:

suspending a plurality of support assemblies from said hanger beams; and installing decking and end forms carried by said plurality of support assemblies prior to said pouring step.

16. The method according to claim 15, wherein each said support assembly comprises:

an inverted T-section having form flanges extending from a hanger flange;

a bracket connected to said hanger flange, said bracket having a hole therethrough;

a J-hanger having a hook receivable in said hole, said J-hanger having a shaft from which said hook extends;

wherein said disposing step further comprises the steps of:

connecting said shaft of each said support assembly to said bottom cross-pieces; and selectively adjusting the length of each said shaft such that said form flanges are supported by said abutment.

17. The method according to claim 16, wherein said disposing step further comprises the steps of:

positioning a trolley between adjacent beams after said suspending step;

carrying said decking to a desired position for placement by said trolley; and repeating said positioning step until said decking extends from one said abutment to the other said abutment.

18. The method according to claim 17, wherein said disconnecting step further comprises the steps of:

cutting said shafts after the concrete has set; and removing said hanger beams and said cross-beams.

19. The method according to claim 15, wherein each said support assembly comprises:

a member; and at least two hangers connected to said member;

wherein said disposing step further comprises the step of:

adjustably connecting the hangers to said bottom cross-pieces, such that said member is substantially at the same level as said abutments.

20. The method according to claim 19, wherein said disposing step further comprises the steps of:

positioning a trolley upon said hanger beams;

temporarily securing said member to said trolley; and positioning said member with said trolley and then performing said adjustably connecting step.

21. The method according to claim 20, wherein said disposing step further comprises the steps of:

positioning another trolley upon said hanger beams after said suspending step;

carrying said decking to a desired position for placement by said another trolley; and repeating said positioning step until said decking extends from one said abutment to the other said abutment.

22. A method for constructing a bridge, comprising the steps of:

disposing at least one bridge form and a connected support structure, over an area to be spanned by the bridge, wherein said disposing step comprises the steps of:

pre-assembling said bridge form and said connected support structure to form a preassembled bridge structure;

coupling a movable counterweight to said pre-assembled bridge structure; and moving said moveable counterweight so that said pre-assembled bridge structure spans the area;

pouring concrete into said at least one bridge form; and disconnecting and removing support structure from said at least one bridge form.

23. The method according to claim 22, further comprising the step of de-coupling said moveable counterweight from said pre-assembled bridge structure.

24. A method for constructing a bridge, comprising the steps of:

disposing at least one bridge form and a connected support structure, over an area to be spanned by the bridge, wherein said disposing step further comprises the steps of:

pre-assembling a first portion of said bridge form and said connected support structure to form a first pre-assembled bridge structure on one side of the area to be spanned;

pre-assembling a second portion of said bridge form and said connected support structure to form a second pre-assembled bridge structure on another side of the area to be spanned;

coupling corresponding moveable counterweights to said first and second preassembled bridge structures;

moving said moveable counterweights so that said first and second pre-assembled bridge structures together to span the area; and connecting said first and second pre-assembled bridge structures to one another;

pouring concrete into said at least one bridge form; and disconnecting and removing support structure from said at least one bridge form.

25. The method according to claim 24, further comprising the step of de-coupling said moveable counterweights from said pre-assembled bridge structures.

* * * * *